United States Patent [19]

Johnsen

[11] Patent Number: 5,044,821

[45] Date of Patent: Sep. 3, 1991

[54] IMPROVEMENT IN A SYSTEM FOR PROTECTING FOUNDATION WALLS AND THE LIKE

[75] Inventor: Finn Johnsen, Notodden, Norway

[73] Assignee: Platon, Notodden, Norway

[21] Appl. No.: 520,234

[22] Filed: May 8, 1990

[30] Foreign Application Priority Data

Jan. 16, 1990 [NO] Norway ..... 900235

[51] Int. Cl.[5] ..... E02B 11/00; E02D 31/02

[52] U.S. Cl. ..... 405/50; 52/169.5; 52/169.14

[58] Field of Search ..... 405/36, 38, 45, 50, 405/229; 52/169.5, 169.14

[56] References Cited

U.S. PATENT DOCUMENTS

| | | | |
|---|---|---|---|
| 4,045,964 | 9/1977 | Barclay | 405/50 |
| 4,745,716 | 5/1988 | Kuypers | 52/169.5 |
| 4,749,306 | 6/1988 | Demeny et al. | 405/45 |
| 4,840,515 | 6/1989 | Freese | 405/45 |

*Primary Examiner*—David H. Corbin

*Attorney, Agent, or Firm*—Morgan & Finnegan

[57] ABSTRACT

Improvement in a system for protecting foundation walls and the like, said system comprising at least one main protecting sheet made of relatively thin, stiff material and including protrusions formed therein, for thereby providing air channels and channels for receiving water from back fill. In order to provide a complete coverage of such foundation walls even by varying height thereof, and in a far more efficient manner, the improvement comprises pre-cut top sheet elements and bottom sheet elements adapted to be mounted along a foundation wall prior to the mounting of said main protecting sheet thereupon, so as to achieve full protecting coverage of said foundation wall in a more rapid and time-saving manner on site. The system also allows for pre-cut corner sheet elements adapted to cover the merging portions of an inner corner or an outer corner of a foundation wall and also adpated to be mounted prior to the mounting of the main protecting sheet thereupon. Special elements are suggested for covering the area of outer or inner corners merging with foundation wall footings.

13 Claims, 6 Drawing Sheets

IMPROVEMENT IN A SYSTEM FOR PROTECTING FOUNDATION WALLS AND THE LIKE

FIELD OF THE INVENTION

The present invention relates to an improvement in a system for protecting foundation walls and the like, said system comprising at least one main protecting sheet made of relatively thin, stiff material and including protrusions formed therein, as well as means for forming air channels and channels for receiving water from back fill.

PRIOR ART

Imperforate protective sheets or membranes or plates, having dimples or studs or other protrusions stamped or otherwise formed therein, have previously been applied to the outside of a foundation wall to create air channels between the web of the sheets and the foundation wall. Examples of such protective sheets can be found in for example U.S. patent specification No. 3 888 087 (Bergsland) and CA 1 186 470 (Bergsland).

The protective sheet according to U.S. No. 3 888 087 comprises laterally spaced courses of vertically spaced dimpled protrusions and similarly formed ribs between said courses. According to CA 1 186 470 the spaced protrusions are constituted by knobs having a reversally directed centrally disposed creater-like portion of truncated conical form, and channels extending between each adjacent knob and opening into the recesses thereof.

However, neither of these publications give any hints for proposing a more effective and rational manner of mounting such protective membranes or sheets for foundation walls, in which the foundation walls have a varying height, and in which the foundation wall comprises inner and outer corners of varying angles, and in which the foundation wall may include a footing at the bottom thereof.

Although U.S. No. 3 888 087 suggests horizontal bending ribs, these bending ribs are only contemplated in connection with main protection sheets of standard height, and only instructs the bending thereof over various footings, under an angle being inefficient for intimate contact between the protective sheet and the footing itself.

Further, although U.S. No. 3 888 087 discloses vertical ribs serving as bending areas and also serving as "levelling" means, no hint is given therein of bending said sheet around or into corners of a foundation wall.

Still further, no embossed bending area is illustrated in U.S. No. 3 888 087, which constitutes a substitute for a regular course of protrusions.

Finally, U.S. 3 888 087 does not provide means for facilitating the mounting of standard main sheets which can be interlocked with a pre-installed top sheet element, thereby reducing labour time and costs involved at the building site in question.

DISCLOSURE OF THE INVENTION

An object of the present invention is to provide an improved system for protecting foundation walls and the like, so as to bring forth complete coverage of foundation walls having varying height in a speedy and rational manner.

Another object of the present invention is to provide such a system for protecting foundation walls in which also the footing of the bottom thereof is given full coverage by the protecting sheet elements involved in said system.

Still another object of the present invention is to provide a system which gives ample coverage of any foundation wall also comprising inner and outer corners of varying angles.

Yet another object of the present invention is to provide an improved system for protecting foundation walls, including sheet elements being adaptable for bending along the lower part of the foundation wall and any footing thereof, and in intimate contact between the protective sheet and said areas to be covered.

A still further object of the present invention is to provide a system for protecting foundation walls in which the protecting elements involved therein comprise embossed bending areas which substitute one or more regular course of protrusions.

Finally, an object of the present invention is to provide for specific types of top sheet elements and bottom sheet elements as well as corner elements which may be preinstalled for the main protecting sheet to be mounted thereon, thereby reducing labour time and costs involved in the total building project.

The above objects are achieved in a system, as stated in the preamble, which according to the present invention, is characterized in that the improvement comprises pre-cut top sheet elements and bottom sheet elements adapted to be mounted along a foundation wall prior to the mounting of said main protecting sheet thereupon, so as to provide for full coverage of said foundation wall.

Preferably, the top sheet element may take the form of a terminating strip having an upper flat surface portion to be attached to the foundation wall, and a further lower resilient strip portion under which a top portion of a main protective sheet may be inserted.

In a preferred embodiment said bottom sheet element is adapted to cover the transition portion between a foundation wall and a merging footing in close association therewith.

Said bottom sheet may then comprise an upper portion adapted to cover the bottom portion of said foundation wall and an angled portion adapted to cover the top surface of said foundation footing, said bottom sheet having a bending area between said upper portion and said angled portion, so as to allow for an angled relationship therebetween adapted to the angle between said foundation bottom portion and said foundation footing top surface.

The improvement also comprises pre-cut corner units adapted to cover the merging portions of an inner corner of a foundation wall, as well as pre-cut corner units adapted to cover the merging portions of an outer corner of a foundation wall. Of course, said corner units may also be a combined unit adapted for covering an inner corner or an outer corner of any foundation wall.

Further advantages and features of the present improved system will appear from the following detailed description of specific non-limiting embodiments taken in conjunction with the appending drawings.

BRIEF DISCLOSURE OF THE DRAWINGS

DETAILED DISCLOSURE OF EMBODIMENTS

Figure 1:
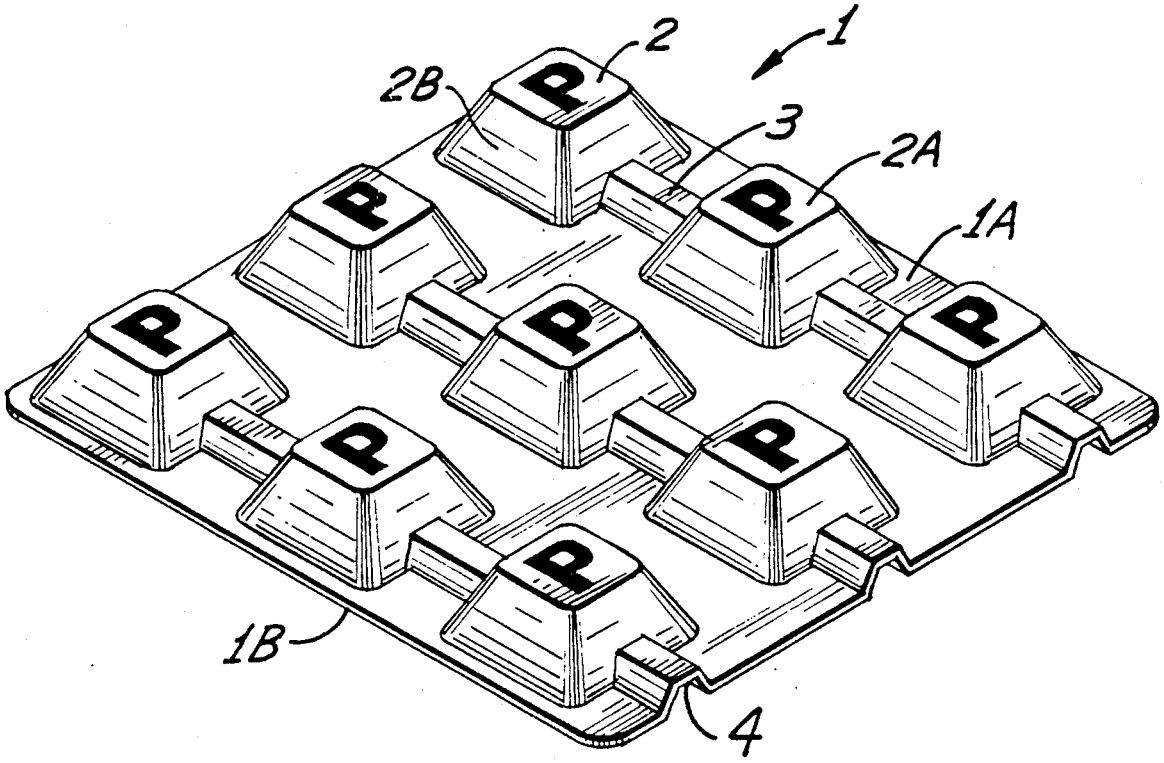
FIG. 1 is a prespective view of a protective sheet which may be implemented in the present foundation wall protecting system.
Figure 2:
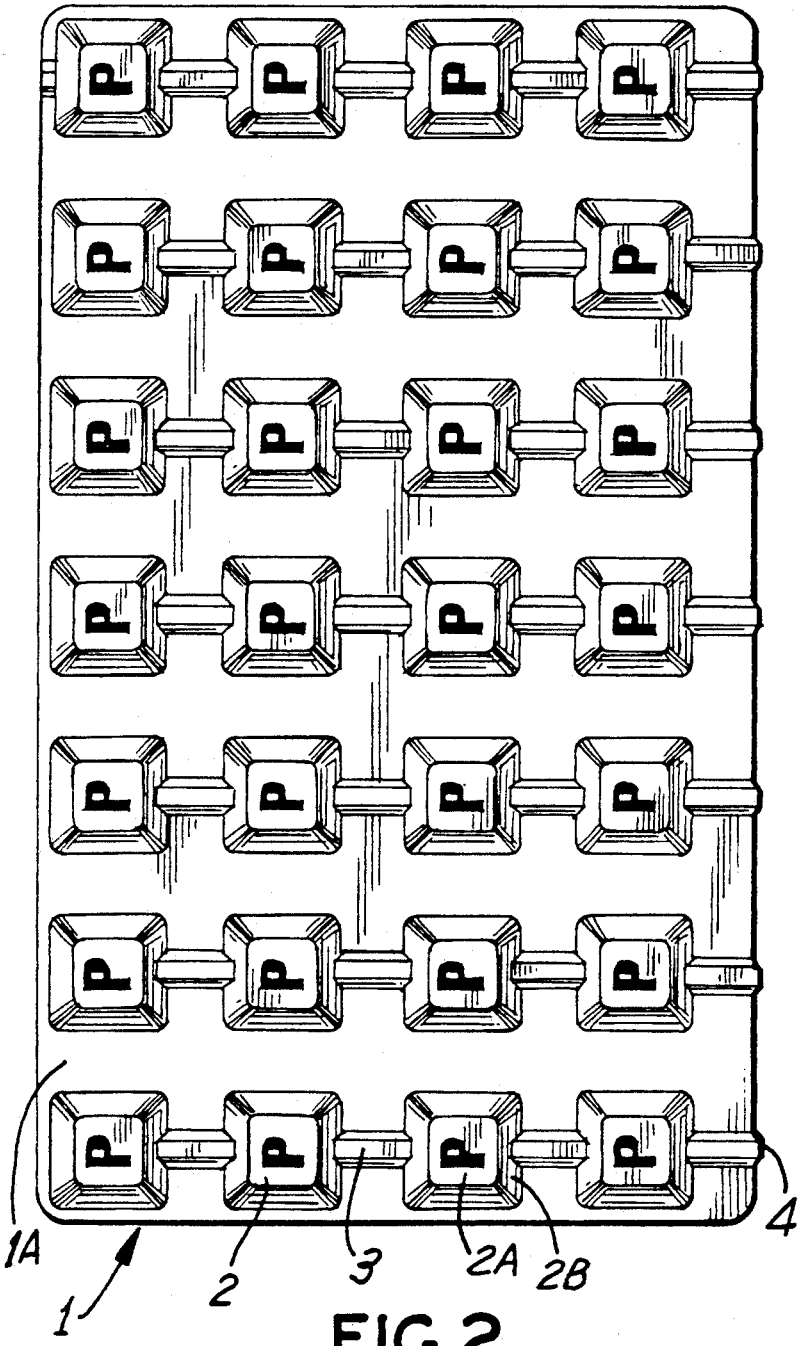
FIG. 2 is a top plan view of the sheet of FIG. 1.
Figure 3:
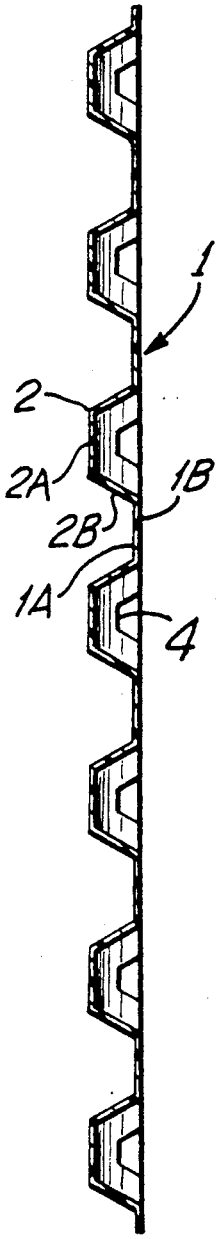
FIG. 3 is a transverse section through the sheet of FIG. 1 and 2.

In FIGS. 1, 2 and 3 there is shown a protective sheet, which is generally designated by reference numeral 1, and which is manufactured from a relatively stiff plastic material, and which before use may be presented in rolled-up form or in sheet form as such. The sheet 1 includes knobs or protrusions 2 protruding from the one surface 1A of said sheet 1, said knobs 2 in this embodiment having the shape of a flat pyramid having a flat top surface 2A and four sloping walls 2B which at the bottom merges with said one side 1A of said sheet 1.

Between each knob 2, there is on the same side 1A of said sheet 1 provided a hollow rib 3, which on the other side 1B provides an open channel 4. Said channels 4 will, as especially illustrated in FIG. 1, extend between each of the knobs 2 so as to form preferably vertically extending continuous channels when said sheet 1 is erected vertically against a foundation wall to be protected thereby.

However, it is to be understood that the shape of the knobs 2 could be different from what is illustrated in FIG. 1-3, for example as disclosed in CA 1 186 470, namely with knobs having a reversally directed centrally disposed crater-like portion of truncated conical form, but still being interconnected with similar ribs 3 or channels 4, so as to form continuous, preferably vertically extending channels when said sheet 1 is erected against a foundation wall.

Figure 4:
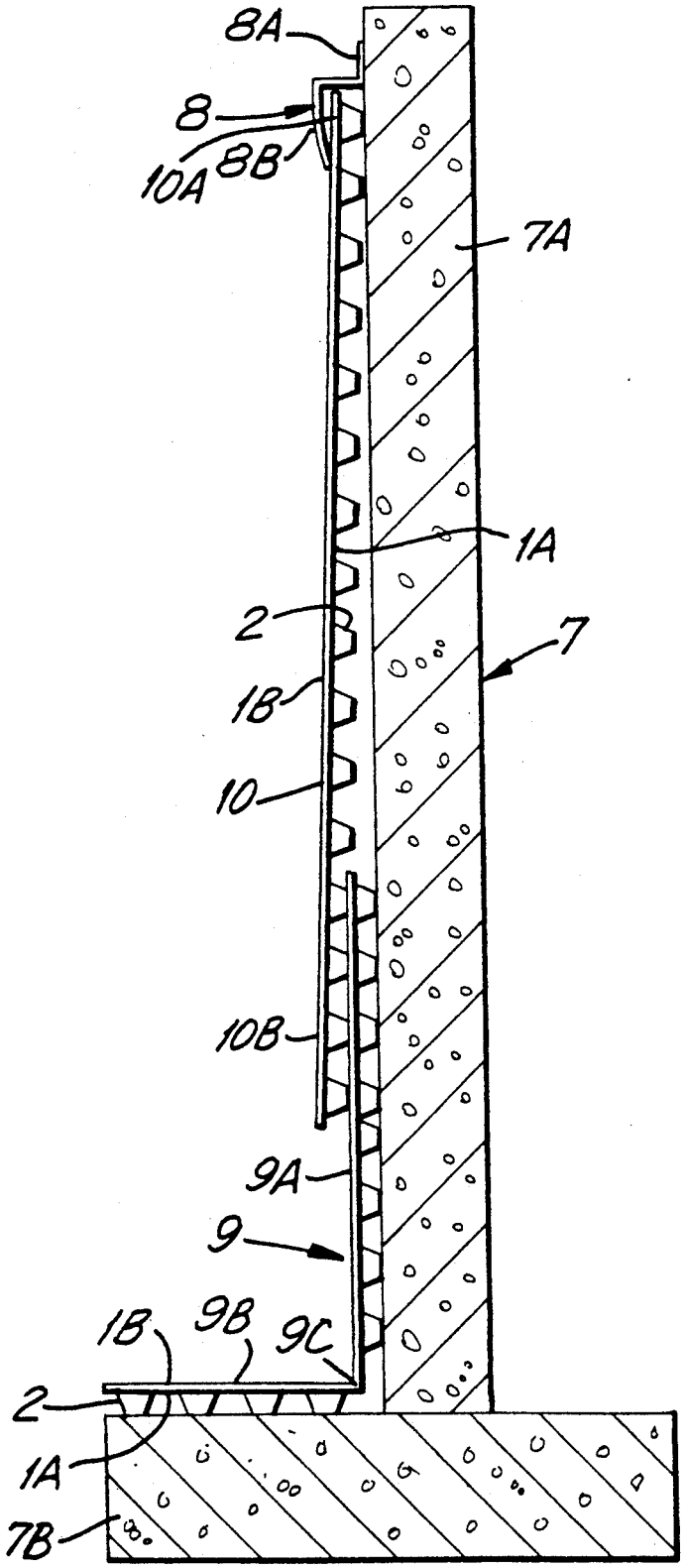
FIG. 4 is a transverse section through a foundation wall with a footing covered by sheet elements according to the present foundation wall protecting system.

In FIG. 4 there is illustrated a transverse section through a foundation wall 7, comprising a wall portion 7A and a footing 7B which is protected by means of the protecting system according to the present invention.

Consequently, at the top of the foundation wall 7 there is illustrated a pre-cut top sheet element 8, whereas at the bottom portion of said foundation wall 7, there is illustrated a bottom sheet element 9, said top sheet element 8 and said bottom sheet element 9 being mounted along the foundation wall 7 prior to the mounting of a main protecting sheet 10 for full coverage of the outer surface of said foundation wall 7.

The top sheet element 8 may also be designated a terminating strip having an upper flat surface portion 8A which is attached to the upper portion of the foundation wall 7, as well as a further lower resilient strip portion 8B under which the top portion 10A of the main protective sheet 10 has been inserted.

Preferably, said top sheet 8 has been attached to the upper portion of said foundation wall 7 by means of gluing, adhesion, bolting or any other appropriate attachment means.

The bottom sheet element 9 is adapted to cover the transition portion between the foundation wall 7A and the merging footing 7B in close association therewith, which means that said bottom sheet 9 comprises an upper portion 9A adapted to cover the bottom portion of the outside of said foundation wall 7A, as well as an angled portion 9B adapted to cover the outer top surface of said foundation footing 7B. In order to facilitate this adaption of the bottom sheet 9 to the various angles constituted by the lower portion of the foundation wall 7A and the top portion of the foundation 7B, said bottom sheet 9 is provided with a bending area 9C between said upper portion 9A and said angled portion 9B, so as to allow for any angled relationship therebetween.

Most appropriately, said bending area 9C is provided in the bottom sheet 9 by substituting at least one row of protrusions or knobs 2, by at least one embossed line constituting said bending area.

It is to be understood that the bottom sheet 9 as well as the main sheet 10 are made up of relatively thin, stiff material and including the type of protrusions disclosed in FIG. 1, 2 and 3, as well as said means for forming air channels and channels for receiving water from back fill disclosed in that connection.

In other words, after the top sheet 8 and the bottom sheet 9 as well as the main sheet 10 have been mounted in a new and effective manner against the outer surface of the foundation wall 7, i.e. with the knobs 2 facing the outer surface of the foundation wall 7, fill mass, e.g. broken stone or other mass having good drainage property, will be put in place against the outer side IB of said bottom sheet element 9 and main sheet element 10, respectively.

This drainage mass may cause a substantial pressure against the sheet elements in question, but the knobs 2 will ensure that the necessary distance between the protective sheet elements and the foundation wall is maintained.

In addition, the channels 4 will provide further drainage along the other side 1B of said sheet elements, which means that the water pressure thereagainst will be reduced.

In case the mass has poor drainage capability, e.g. clay or fill mass containing earth, it may be desirable to arrange a filtration canvas externally against the outer side 1B of said sheet elements, whereby water is filtrated through said canvas and escapes via the channels 4. In that case, the filtrating canvas will prevent the channels 4 from being blocked by said poor drainage capability mass. It should also be understood that if filtrating canvas is used, knobs having crator-like portions will effectivily constitute a further support of the canvas, and thus preventing same from being pressed into the recesses formed by the knobs.

In the arrangement illustrated in FIG. 4, the premounting of the top element 8 and the bottom element 9, will cater for the variations in height along the foundation wall, and provide full overlapping by the main protective sheet 10 if this is supplied in plates of standard height, for example 9′=2.70 meters.

It is further to be understood that in the embodiment disclosed in connection with FIG. 4, it should be noted that the sides of the main sheet 10 may be overlapped by the adjacent main sheet, so as to provide continuous sheet protection of the foundation wall, this overlapping of the main sheets 10 providing an interlocking action between the side edge protrusions or knobs 2 of adjacent main sheets.

As regards the interlocking action between the main protective sheets 10 and the bottom sheet elements 9 to be overlapped thereby, this interlocking function may be dispensed with, depending on the level of the footing 7B in relation to the top element 8A, it nevertheless being noted that the overlapping portions of the lower area 10B and the upper area 9A of the bottom sheet element 9 is quite satisfactorily even if the interlocking action between corresponding knobs do not register with each other exactly.

However, the interlocking function between adjacent main sheets 10 facilitates the mounting thereof, since the workers do not have to level each sheet separately, but can use the previously mounted sheet as a reference.

Figure 5:
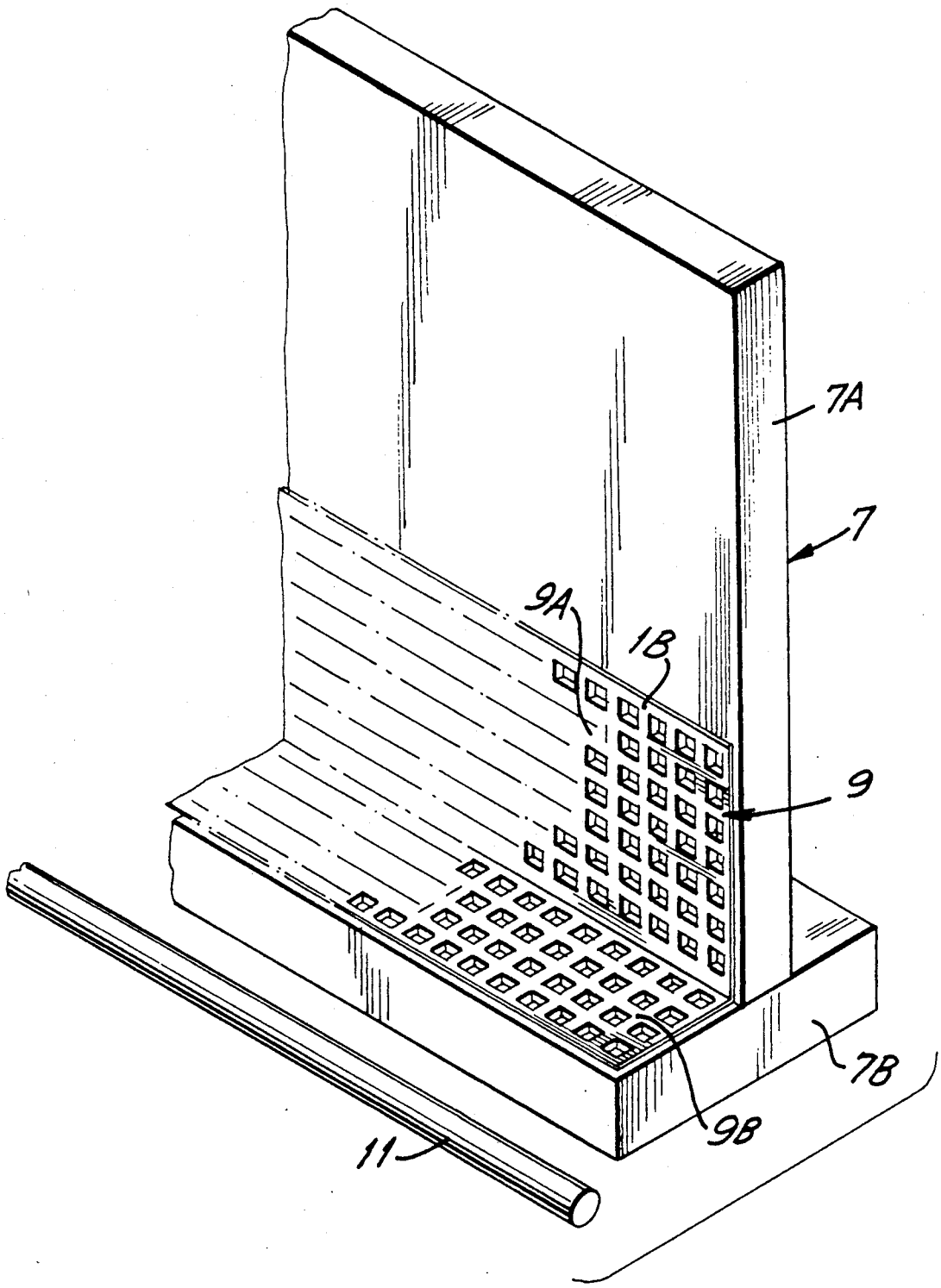
FIG. 5 is a perspective view of a foundation wall with a footing, in which only a bottom sheet element has been installed.

In FIG. 5 there is illustrated a perspective view of a foundation wall 7 as disclosed in connection with FIG. 4, and from FIG. 5 it is obvious that the bottom sheet element 9 can be delivered in running length, and be cut in appropriate sizes on the site, so as to be included as a first step in the implementation of the present improved system for protecting foundation walls and the like.

In FIG. 5 there is also illustrated a drainage pipe 11 which has the function of bringing the drainage from the filling material away from the foundation wall 7.

Figure 6:
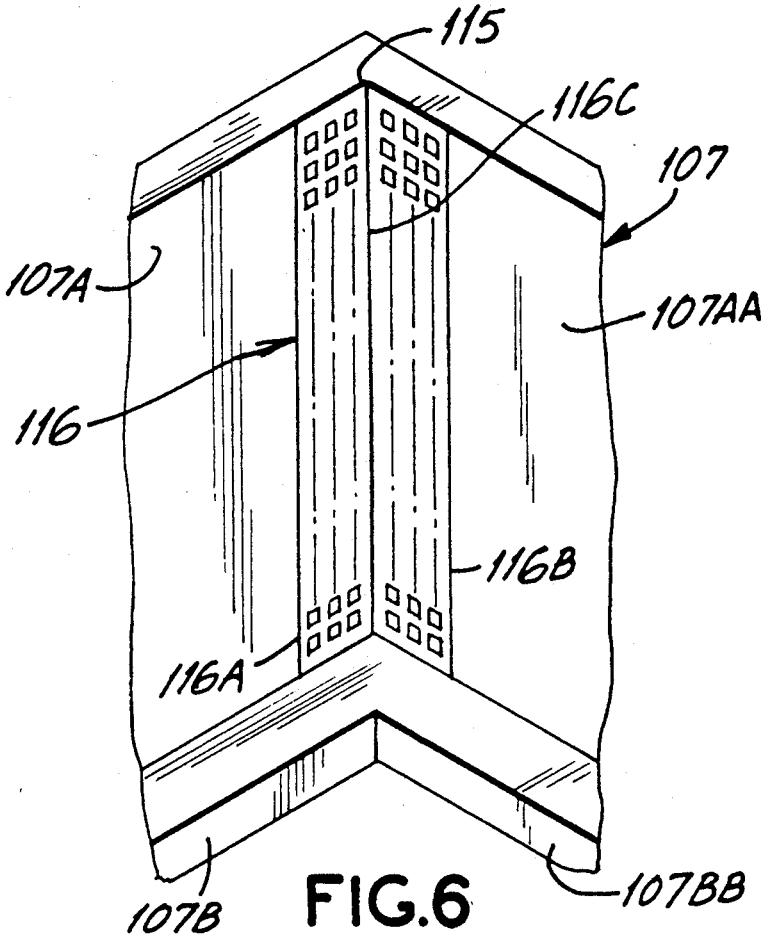
FIG. 6 is a perspective view of a foundation wall with a footing, in which a corner sheet element has been installed in an inner corner of said wall.

In FIG. 6 there is in a perspective view illustrated a foundation wall 107 having wall portion 107A and 107AA merging in an inner corner 115, and having footings 107B and 107BB for each wall portion, respectively.

Further, FIG. 6 illustrates a pre-cut corner unit 116, adapted to cover the merging portions 107A and 107AA of the foundation wall 107, so as to cover the corner portion 115 thereof.

This corner unit 116 may be provided in running lengths and comprises along a central aera thereof a bending area between sheet portions 116A and 116B covering a respective corner portion of the foundation wall 107 in question, namely at any appropriate angle.

It is to be understood that this bending area 116C may, as discussed in connection with the bottom sheet element 9 in connection with FIG. 4, comprise an embossed line which has been provided during the manufacturing thereof, namely as a substitute for at least one row of dimples or knobs.

The mounting of this corner sheet element 116 constitutes one of the first installation steps in the improved system according to the present invention, in the same manner as discussed previously as regards the bottom sheet element 9 and the top sheet element 8.

Figure 7:
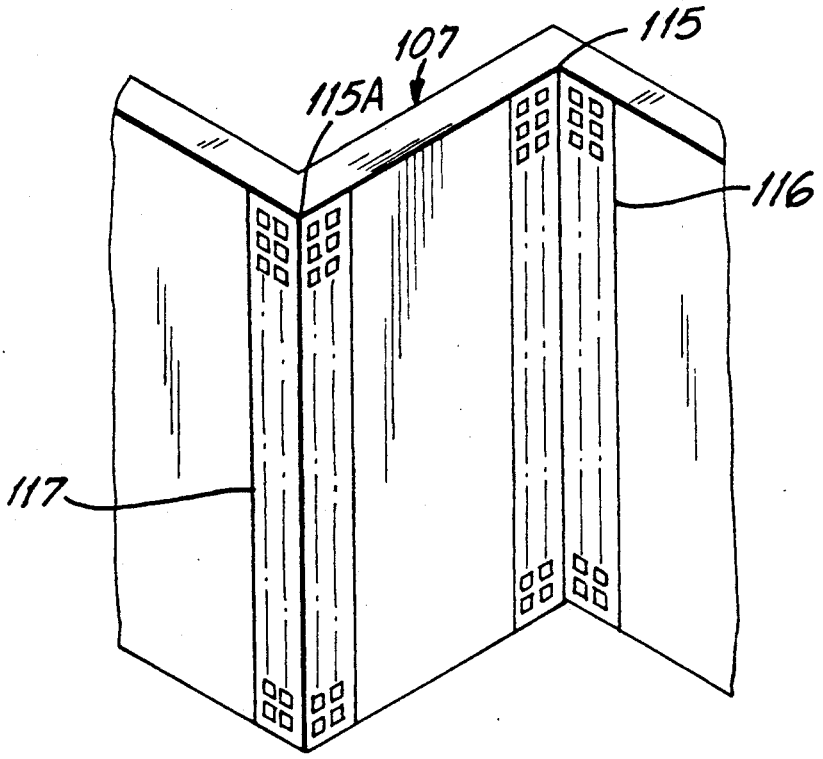
FIG. 7 is a perspective view of a foundation wall, in which not only a corner sheet element has been installed in an inner corner of said wall, but in which also an outer corner sheet has been installed on an outer corner thereof.

In FIG. 7 there is illustrated a combination of two sheet corner units in which a first corner unit 116 is adapted to cover the merging portions of an inner corner 115 of a foundation wall 107, whereas a second sheet corner unit 117 is adapted to cover the merging portions of an outer corner 115A of the same foundation wall 107.

It is to be understood that said sheet corner units 116 and 117, respectively, may constitute a combined unit adapted for covering either an inner corner of a foundation wall, or an outer corner of any foundation wall, all in accordance with the requirements on site.

Figure 8A:
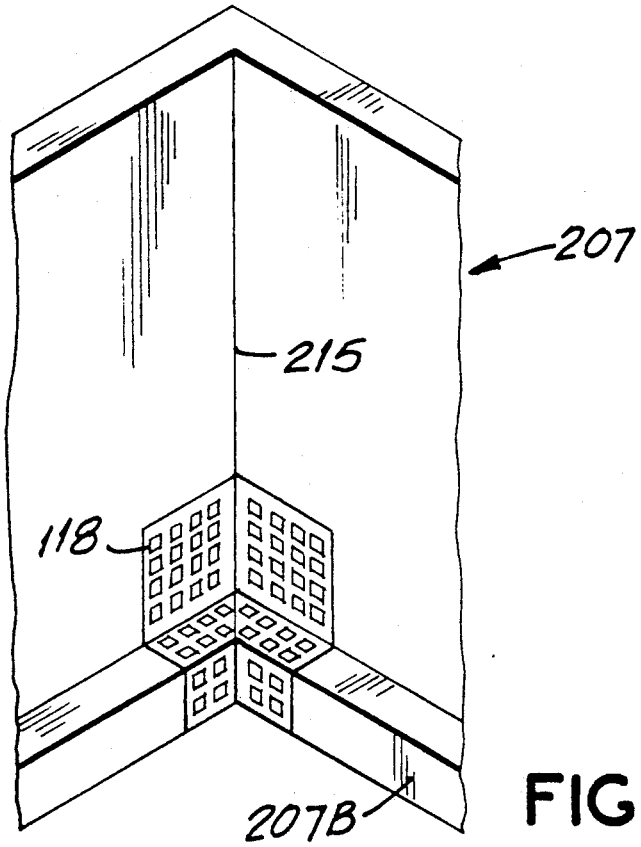
FIG. 8A and FIG. 8B illustrate combined bottom corner sheet elements for an inner corner and an outer corner, respectively, of a foundation wall with footing.
Figure 8B:
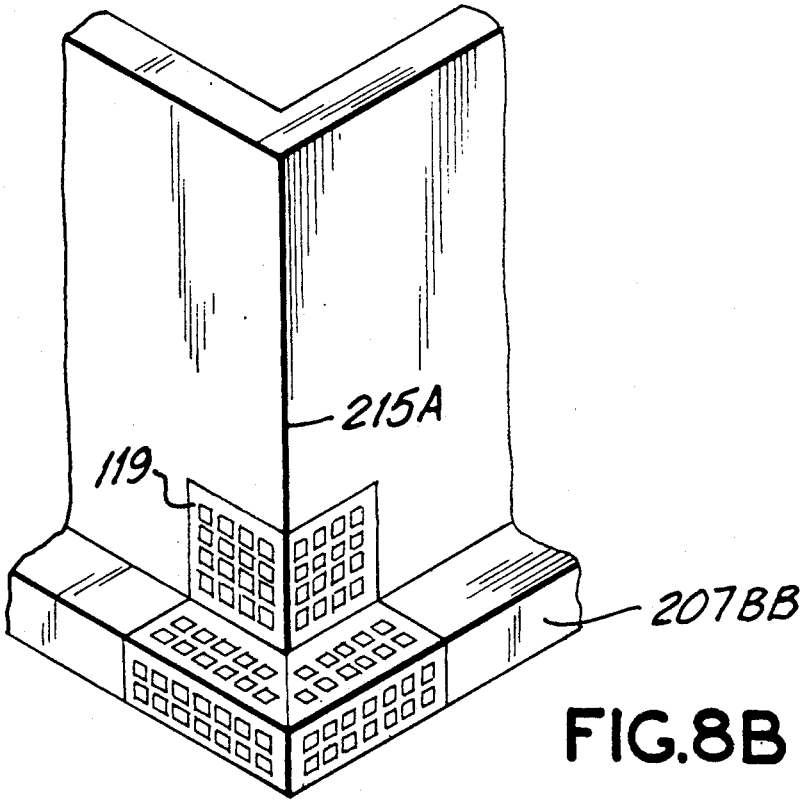

FIG. 8A illustrates how the lower portion of an inner corner 215 of a foundation wall 207 in the area of the footing 207B may be covered by a special embodiment of a corner base element 118, whereas FIG. 8B illustrates a special embodiment of a corner base element 119 which is to be used for covering the outer corner portion 215A in the area of the footing 207BB of a foundation wall.

By having top sheet elements, bottom sheet elements as well as corner sheet elements mounted as the first steps of the overall system, then afterwards the larger main sheet elements can be mounted in a far more rapid and efficient manner.

I claim:

1. A system for protecting foundation walls and the like, said system comprising at least one main protecting sheet made of imperforate, relatively thin, stiff material and including protrusions formed therein, as well as means extending between said protrusions for forming air channels and channels for receiving water from back fill, and imperforate pre-cut top sheet elements and bottom sheet elements adapted to be mounted along a foundation wall prior to the mounting of said main protecting sheet thereupon for full outer coverage of said foundation wall against surrounding fill mass.

2. A system as claimed in claim 12, wherein said top sheet element takes the form of a terminating strip having an upper flat surface portion to be attached to the foundation wall, and a lower resilient strip portion under which a top portion of a main protective sheet may be inserted.

3. A system as claimed in claim 2, wherein said top sheet element is attached with its upper portion to said foundation wall by means of gluing, adhesion, bolting or any other appropriate attachment means.

4. A system as claimed in claim 12, wherein said bottom sheet element is adapted to cover the transition portion between a foundation wall and is merging footing in close association therewith.

5. A system as claimed in claim 4, wherein said bottom sheet element comprises an upper portion adapted to cover the bottom portion of said foundation wall and an angled portion adapted to cover the top surface of said foundation rooting, said bottom sheet element having a bending area between said upper portion and said angled portion, so as to allow for an angled relationship therebetween adapted to any angle between said foundation bottom portion and said foundation footing top surface.

6. A system as claimed in claim 5, wherein said bending area of said bottom sheet element is provided in an area in which a row of protrusions in said sheet material has been deleted and substituted by at least one embossed line constituting said bending area.

7. A system as claimed in claim 1, wherein the system further comprises corner sheet elements adapted to be mounted against foundation wall at top, bottom and corners thereof, respectively, prior to the mounting of the main protecting sheet thereupon.

8. A system as claimed in claim 1, wherein said means extending between said protrusions extend vertically between said protrusions when the protecting sheet is erected against the foundation wall and the like.

9. A system for protecting foundation walls and the like, said system comprising at least one main protecting sheet made of an imperforate relatively thin, stiff material and including protrusions formed therein, as well as means extending between said protrusions for forming air channels and channels for receiving water from back fill, and at least one imperforate pre-cut corner sheet element adapted to cover merging portions of an inner corner of a foundation wall prior to the mounting of said main protecting sheet thereupon for full outer coverage of said foundation wall against surrounding fill mass.

10. A system as claimed in claim 9, wherein said corner sheet elements constitute combined units adapted for covering an inner corner of a foundation wall or an outer corner of the same or another foundation wall.

11. A system as claimed in claim 10, wherein said combined corner sheet element is provided in running lengths and comprises along a central area thereof, a bending area between sheet portions covering a respective corner portion of a foundation wall at any angle.

12. A system as claimed in claim 11, wherein said bending area is provided as an embossed line replacing a row of protrusions in said sheet material, for thereby allowing a bending function for both inner and outer corner portions at any angle in a foundation wall.

13. A system as claimed in claim 9, wherein said means extending between said protrusions extend vertically between said protrusions when the protecting sheet is erected against the foundation wall and the like.

* * * * *